United States Patent [19]

Randall

[11] 4,202,137

[45] May 13, 1980

[54] SLIDING DOOR OR WINDOW

[75] Inventor: Robert P. Randall, Pittsburgh, Pa.

[73] Assignee: Three Rivers Aluminum Company, Pittsburgh, Pa.

[21] Appl. No.: 958,709

[22] Filed: Nov. 8, 1978

[51] Int. Cl.[2] ..... E05D 15/08

[52] U.S. Cl. ..... 49/458; 49/473

[58] Field of Search ..... 49/458, 473

[56] References Cited

U.S. PATENT DOCUMENTS

| | | | |
|---|---|---|---|
| 3,225,393 | 12/1965 | Coller | 49/458 X |
| 3,324,597 | 6/1967 | Rich | 49/458 X |
| 4,064,653 | 12/1977 | Randall et al. | 49/458 |

FOREIGN PATENT DOCUMENTS

| | | | |
|---|---|---|---|
| 2628054 | 6/1976 | Fed. Rep. of Germany | 49/458 |

*Primary Examiner*—Kenneth Downey

*Attorney, Agent, or Firm*—Brown, Flick & Peckham

[57] ABSTRACT

A pair of rectangular sash, framing glass panes for normally closing an opening in a wall, overlap each other at one end, with one sash slidable horizontally relative to the other to open said opening. Each overlapping end includes a vertical sash rail provided with horizontally spaced inner and outer vertical flanges extending toward the opposite end of the sash that carries those flanges, with all of the flanges disposed between the rails. The inner flanges of the two rails are spaced apart and located between the outer flanges in overlapping engagement with them to interlock the two rails. Disposed in the space between the inner flanges is a pair of vertical weather-sealing strips, each of which is connected to a sash. The strips extend toward each other and into contact to form a weather seal between the rails.

5 Claims, 5 Drawing Figures

SLIDING DOOR OR WINDOW

It is among the objects of this invention to provide a sliding door or window, in which two sash are interlocked when they are in closed position and which is sealed against wind and water passing between the overlapping portions of the closed sash.

The preferred embodiment of the invention is illustrated in the accompanying drawings, in which FIG. 1 is a fragmentary view of the outside of a door;

Figure 1:
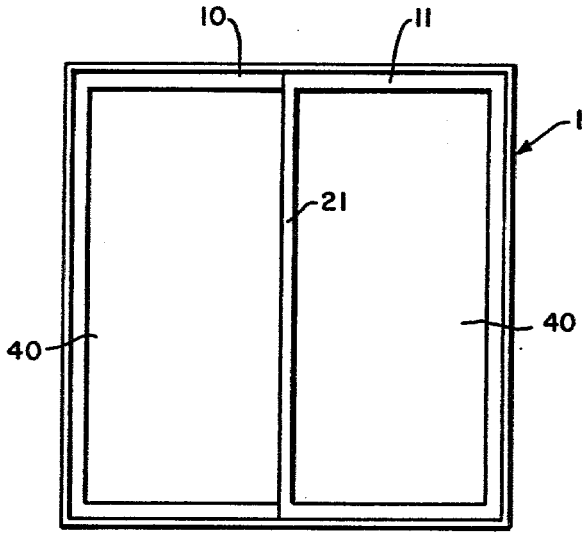
Figure 2:
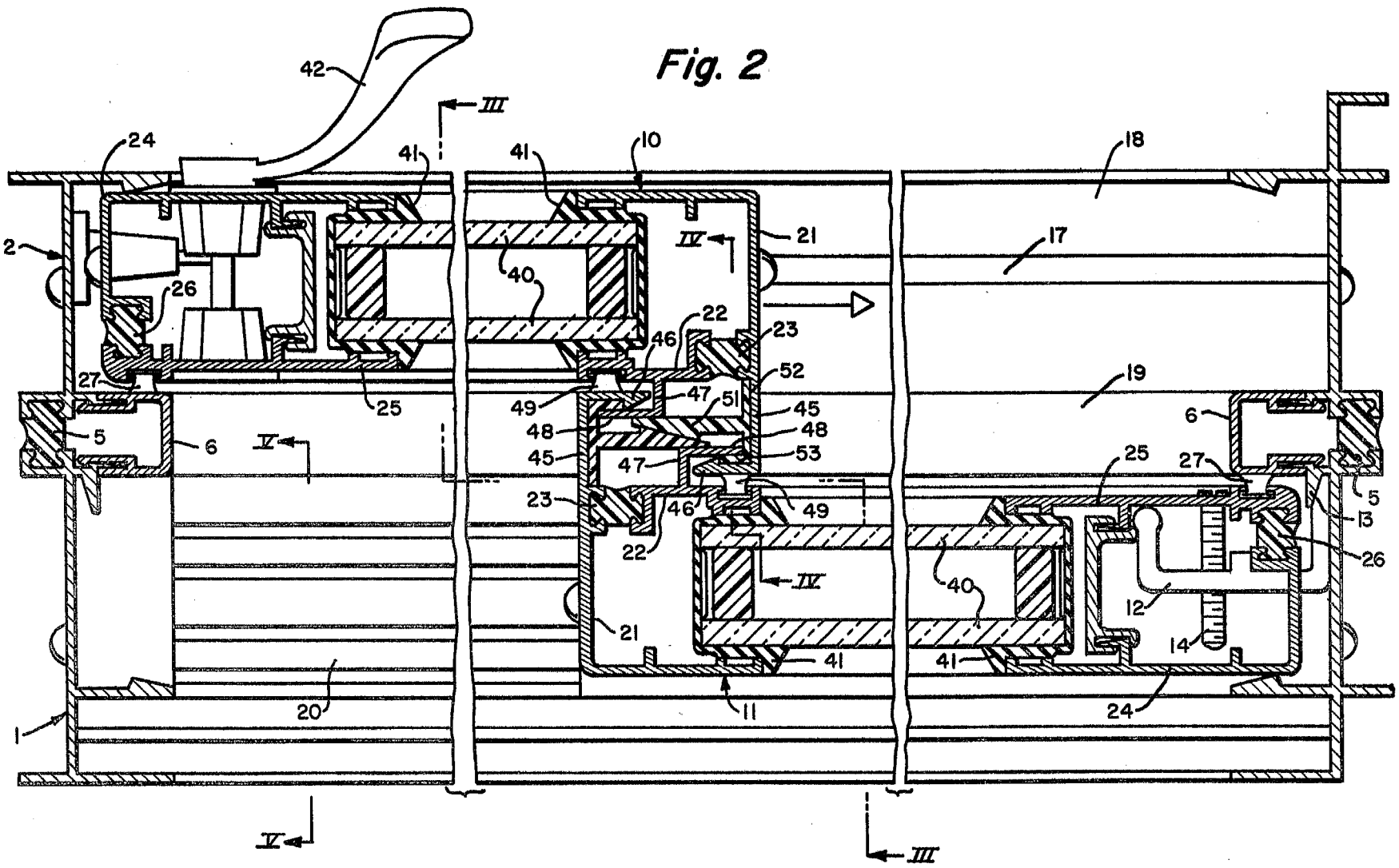
FIG. 2 is an enlarged fragmentary horizontal section taken on the line II—II of FIG. 1.
Figure 3:
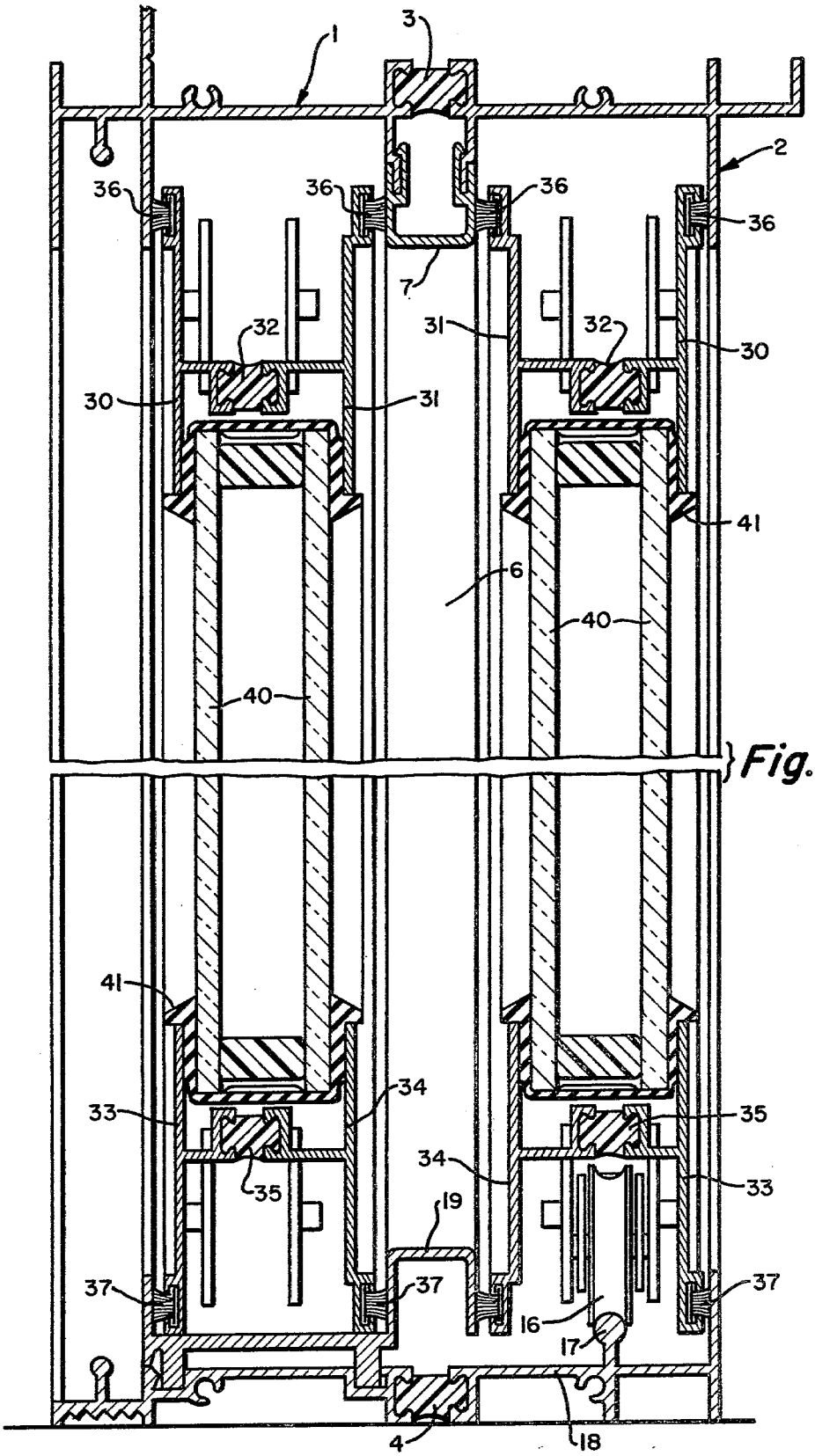
FIG. 3 is a vertical section taken on the line III—III of FIG. 2.

Referring to FIGS. 2 and 3 of the drawings, a door is formed from two rectangular door frames 1 and 2 disposed one behind the other, with a metal sash mounted in each frame. The two metal frames are rigidly connected together top and bottom by rigid polyurethane bars 3 and 4 projecting into grooves in the frames and thermally insulating them from each other. The ends of the frames are connected in the same way by vertical rigid polyurethane bars 5. As shown in FIG. 2, at each end of the frames there is an inwardly extending vetical bar 6 that forms an end of the opening between the two frames. A similar bar 7 (FIG. 1) forms the top of the opening and also serves as part of the inner walls of downwardly opening sash-receiving channels in the upper parts of the door frames.

The door frames are of such length that the left-hand end of one sash overlaps the right-hand end of the other sash when the door is closed. Sash 10 mounted in frame 2, which is the inner frame, is called the inner sash. The other sash, sash 11, is the outer sash. The two sash are interchangeable. The inner sash can be moved horizontally from its closed position toward the opposite end of its frame to open the door, but the outer sash 11 preferably is locked in permanently closed position by a clip 12 that hooks onto a projection 13 on the end of the outer frame. The clip is held in locking position by a screw 14.

Figure 5:
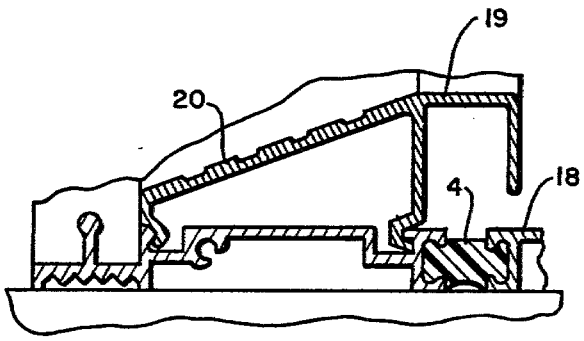
FIGS. 4 and 5 are fragmentary vertical sections taken on the lines IV—IV and V—V of FIG. 2.
Figure 4:
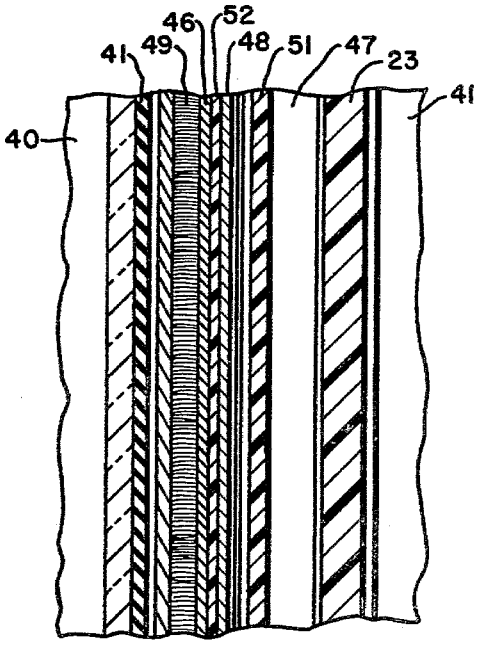

Preferably the bottom of the inner sash 10 is provided with grooved rollers 16 that travel on a raised track 17 beneath the sash as shown in FIG. 3. The track, located in a lower channel for the door, projects above a metal sill member 18 that forms the bottom of the door frame. The sill member of the other door frame has an upwardly extending portion 19 along one edge which forms the bottom of the opening between the two frames. The outer door frame 1 in front of the sliding inner sash has a sloping sill 20, as shown in FIG. 5.

Each metal sash has vertical end rails at its ends in the form of vertical channels. As shown in FIG. 2, the overlapping end rails are each formed from two metal parts 21 and 22 connected together by a rigid polyurethane thermal insulating bar 23 inserted in grooves in the two metal parts. The opposite or outer end rails likewise are each formed from two metal parts 24 and 25 rigidly connected by a rigid polyurethane bar 26. These outer end rails are disposed in the end channels of the window frames as shown. The end rails are provided with vertical T-slots, in which strips 27 of wool pile or the like are mounted for engaging the inner walls of the channels to seal the space between the end rails and the door frames.

As shown in FIG. 3, the top rail of each sash is in the form of a downwardly opening channel formed from two metal parts 30 and 31 rigidly connected by a rigid polyurethane bar 32. A bottom rail for each sash is formed like the other rails from two metal parts 33 and 34 connected by a rigid polyurethane bar 35. The adjoining ends of the rails are connected to one another. The top and bottom rails carry horizontal strips 36 and 37 of wool pile or the like that engage and slide along the opposing sides of the top and bottom channels of the door frames.

Mounted in the channels of each sash are a pair of laterally spaced window panes 40, the marginal portions of which fit tightly in a surrounding rubber or soft vinyl plastic channel member 41 pressed tightly into the sash channels. The inner door sash 10 normally is locked in closed position by a suitable latching mechanism that can be unlocked by turning a door handle 42, which then can be used for sliding the door open.

It is a feature of this invention that joined to each overlapping vertical sash rail, between it and the other sash, there is a vertical metal bar 45 that extends toward the other sash rail and is integrally joined to one edge of a vertical flange 46 that extends toward the opposite end of the sash. This bar preferably is integral with the rail that supports it. Another vertical metal bar 47 parallel to bar 45, also extends away from the same sash, but for a shorter distance, and is joined to one edge of an inner flange 48 parallel to outer flange 46 and extending in the same direction. The two inner flanges 48 of the two rails are spaced apart and are disposed between the two outer flanges 46, with which they are in overlapping engagement to interlock the two rails so that the two sash will not be able to move transversely away from each other when the door is closed.

The overlapping end rails of the sash carry vertical strips 49 of wool pile or the like that press against the opposing outer flanges 46.

Another feature of this invention is that a pair of vertical nonmetallic weather-sealing strips, preferably made of a rigid vinyl plastic, are disposed in the space between inner flanges 48 and are connected to the two sash. These strips engage each other to form a weather seal between the overlapping rails. The strips have body portions 51 that overlap each other along a vertical plane diagonal to the sash to permit them to be wedged together. The overlapping portions of the strips are pressed tightly against each other by inner flanges 48 that they also engage. Each strip also has a vertically extending base portion 52 engaging a rail part 21 and a bar 45 and the outer flange 46 joined to that bar. This base portion holds the strip in place. Preferably, the inner side of each outer flange 46 is provided with a vertically extending recess 53 beside the adjoining inner flange 48, and the base portion of the adjoining strip fills this recess and also engages the inner flange of the other rail. With this arrangement of weather-sealing strips, when the door is closed the two sealing strips are wedged together to form a tight weather seal between the overlapping portions of the two sash. Bars 45 can slide vertically on the weather-sealing strips when the sash are being installed in the frames or removed.

Although the invention has been illustrated as applied to a sliding door, it should be understood that it applies equally well to sliding windows. The following claims are intended to cover both, and also to a situation in which both sash can be moved horizontally if desired.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A pair of rectangular sash framing glass panes for normally closing an opening in a wall, one sash being slidable horizontally relative to the other to open said opening, said sash being disposed in parallel vertical planes with the right-hand end of one sash normally overlapping the left-hand end of the other sash, said overlapping ends including vertical sash rails, each rail being provided with horizontally spaced inner and outer vertical flanges extending toward the opposite end of the same sash, all of said flanges being disposed between said rails, the inner flanges of the two rails being spaced apart and disposed between said outer flanges in overlapping engagement therewith to interlock the two rails, and a pair of vertical weather-sealing strips disposed in the space between said inner flanges, each strip being connected to a sash rail with the strips extending toward each other and overlapping along a vertical plane diagonal to the sash, each strip being disposed between the inner flange connected to the same rail as that strip and the other strip, and the strips engaging each other in said plane to form a weather seal between said rails.

2. A pair of sash according to claim 1, in which the overlapping portions of said strips press against said inner flanges.

3. A pair of sash according to claim 1, in which the sliding sash is a door sash.

4. A pair of rectangular sash framing glass panes for normally closing an opening in a wall, one sash being slidable horizontally relative to the other to open said opening, said sash being disposed in parallel vertical planes with the right-hand end of one sash normally overlapping the left-hand end of the other sash, said overlapping ends including vertical sash rails, each rail being provided wth horizontally spaced inner and outer vertical flanges extending toward the opposite end of the same sash, all of said flanges being disposed between said rails, the inner flanges of the two rails being spaced apart and disposed between said outer flanges in overlapping engagement therewith to interlock the two rails, a vertical bar joined to each rail and supporting the outer flange of that rail, each bar extending across the free edge of the inner flange of the other rail, and a pair of vertical weather-sealing strips disposed in the space between said inner flanges, each strip having a vertically extending base portion engaging one of said bars and the adjoining rail and the outer flange joined thereto to position the strip, the strips extending toward each other and overlapping along a vertical plane diagonal to the sash and engaging each other in said plane to form a weather seal.

5. A pair of sash according to claim 4, in which the inner side of each outer flange is provided with a vertically extending recess beside the adjoining inner flange, and said base portion of a sealing strip fills said recess and engages said adjoining inner flange.

* * * * *